US010008818B2

(12) United States Patent
Malanca

(10) Patent No.: US 10,008,818 B2
(45) Date of Patent: Jun. 26, 2018

(54) ELECTRICAL DEVICE WITH TERMINAL AND WIRE-STRIPPING SEAT

(71) Applicant: 4 BOX SRL, Milan (IT)

(72) Inventor: Pietro Malanca, Parma (IT)

(73) Assignee: 4 BOX SRL, Milan (IT)

( * ) Notice: Subject to any disclaimer, the term of this patent is extended or adjusted under 35 U.S.C. 154(b) by 0 days. days.

(21) Appl. No.: 15/549,718

(22) PCT Filed: Feb. 9, 2016

(86) PCT No.: PCT/IB2016/050673

§ 371 (c)(1),
(2) Date: Aug. 9, 2017

(87) PCT Pub. No.: WO2016/128892

PCT Pub. Date: Aug. 18, 2016

(65) Prior Publication Data

US 2018/0034226 A1 Feb. 1, 2018

(30) Foreign Application Priority Data

Feb. 10, 2015 (IT) ..... 102015000005840

(51) Int. Cl.
*H01R 43/28* (2006.01)
*H01R 9/24* (2006.01)
*H01R 9/26* (2006.01)

(52) U.S. Cl.
CPC ..... *H01R 43/28* (2013.01); *H01R 9/2408* (2013.01); *H01R 9/2491* (2013.01); *H01R 9/26* (2013.01)

(58) Field of Classification Search
CPC ..... H01R 43/28
See application file for complete search history.

(56) References Cited

U.S. PATENT DOCUMENTS

| | | | | |
|---|---|---|---|---|
| 4,372,041 | A * | 2/1983 | Winkelman | H01R 43/28 198/474.1 |
| 4,820,192 | A | 4/1989 | Denkmann et al. | |
| 2007/0093121 | A1* | 4/2007 | Helmreich | H01H 50/14 439/495 |
| 2008/0096441 | A1* | 4/2008 | Eppe | H01R 4/4827 439/816 |

(Continued)

FOREIGN PATENT DOCUMENTS

| | | | |
|---|---|---|---|
| EP | 2088649 | A1 | 8/2009 |
| GB | 2504279 | A | 1/2014 |
| JP | 2004104912 | A | 4/2004 |

OTHER PUBLICATIONS

PCT International Search Report and Written Opinion dated May 18, 2016 for Intl. App. No. PCT/IB2016/050673, from which the instant application is based, 10 pgs.

*Primary Examiner* — James Harvey
(74) *Attorney, Agent, or Firm* — Fredrikson & Byron, P.A.

(57) ABSTRACT

An electrical device (10) comprises at least one electric terminal (11) of the type intended to receive and connect a stripped end of an insulated electric wire. A surface (14) of the device is provided with at least one seat (15) for cutting and stripping one end of an insulated wire. This seat (15) is intended to cut the insulation of the insulated wire and strip it from the end of the wire by means of insertion of the end of the wire into the seat (15) followed by axial pulling of the wire before inserting the wire inside the terminal (11).

9 Claims, 3 Drawing Sheets

(56) References Cited

U.S. PATENT DOCUMENTS

| | | | | |
|---|---|---|---|---|
| 2009/0235522 | A1* | 9/2009 | Kihara | H01R 43/052 29/863 |
| 2018/0034226 | A1* | 2/2018 | Malanca | H01R 43/28 |

* cited by examiner

ELECTRICAL DEVICE WITH TERMINAL AND WIRE-STRIPPING SEAT

RELATED APPLICATIONS

This application is a 35 U.S.C. 371 national stage filing from International Application No. PCT/IB2016/050673, filed Feb. 9, 2016, which claims priority to Italian Application No. 102015000005840, filed Feb. 10, 2015, the teachings of which are incorporated herein by reference.

FIELD OF THE INVENTION

The present invention relates to an electrical device which comprises at least one electric terminal intended to receive and connect a stripped end of an electric wire of the insulated type.

The terminals may be of various known types such as screw type, push-grip type, etc.

BACKGROUND

Usually the known devices envisage the need to use scissors or a suitable wire-stripping tool in order to free the end of an electric wire to be connected to the terminal from a section of insulating sheathing. After the electric wire has been prepared in this way it is possible to introduce it into the corresponding electric terminal and fix it so as to establish the electrical connection. This operation must be carried out in the same way for all the electric wires to be connected.

In the prior art various drawbacks exist. Firstly it is required to have a suitable tool in order to perform removal of the section of insulation. Furthermore, it may happen that the stripping operation is performed in an unsatisfactory manner, for example with a stripped section which is too short or too long for the terminal intended to receive it, resulting in a non-optimal connection, the risk of leaving an exposed section of uninsulated wire and/or the need to perform further operations on the wire, increasing the section which has not been sufficiently stripped or, on the other hand, shortening the end of the conductor wire from which too much insulation has been stripped.

Apart from the amount of lost time, the unsatisfactory connection or the exposure of a section without insulation after connection results in a significant risk of an electric shock, short-circuit or overheating of the connection points.

In the prior art adjustable wire-stripping tools have been proposed such that it is possible to set beforehand the length of the section which is stripped by the tool. However, defining the correct setting is in any case dependent on the skill and experience of the person performing the operation. Moreover, usually the terminal is embedded inside the device and only the inlet opening for the wire is visible from the outside. It is therefore not possible to know beforehand exactly the depth of the connection hole inside the terminal which must receive the stripped end of the wire and what is the optimum length of the stripped section to be introduced, which needs to be set on the stripping tool.

BRIEF SUMMARY OF EMBODIMENTS OF THE INVENTION

The electrical devices involved here may be of various types, as will become clear below to the person skilled in the art, but in particular the invention may be of great advantage in electrical devices of the modular type used for the realization of electrical installations.

For example, devices of the modular type may be designed to be engaged in a receiving and fixing frame, where necessary alongside other modules, which are to be mounted in the installation. The modules usually have a generally parallelepiped form with a front side (provided with a socket, an electric control device such as a switch, pushbutton, etc., or other electric components) which is intended to form the visible part of the module after it has been arranged in position in the installation. The fixing frame may usually be of the type which must be fixed in a special seat, such as that formed by a wall-mounted box to where the electric wires—for connection to the terminals arranged at the rear of the module—arrive.

In the case of modular devices, usually their side faces comprise means (advantageously of the snap-engaging type) for engagement in the seat or in the frame and the terminal or the terminals are positioned close to or on the rear surface of the module.

The assembly of an installation using these modules envisages the connection of many wires and therefore the need for many stripping operations. Moreover, once assembly of the installation has been completed the connections are no longer visible and it is essential that they should be correctly performed. It should also be considered that, precisely because of the modular nature of the installation, once it has been assembled the need may arise at a later time to be able to add or replace a module and in this case a suitable tool for correctly stripping any wires which are added or must be re-stripped may not be immediately available.

The general object of the present invention is to provide electrical devices which themselves are able to allow, in a simple and rapid manner, the preparation of conductor wires which have been correctly stripped for connection to the corresponding terminals, without the need for additional tools.

In view of this object the idea which has occurred is to provide, according to the invention, an electrical device comprising at least one electric terminal of the type intended to receive and connect to the device a stripped end of an insulated electric wire, characterized in that a surface of the device is provided with at least one seat for cutting and stripping one end of an insulated wire, intended to cut the insulation of the insulated wire and strip it from the end of the wire by means of insertion of the end of the wire into the seat followed by axial pulling of the wire before inserting the wire inside the terminal.

BRIEF DESCRIPTIONS OF DRAWINGS

In order to illustrate more clearly the innovative principles of the present invention and its advantages compared to the prior art, examples of embodiment applying these principles will be described below with the aid of the accompanying drawings. In the drawings.

DETAILED DESCRIPTION OF EMBODIMENTS OF THE INVENTION

Figure 1:
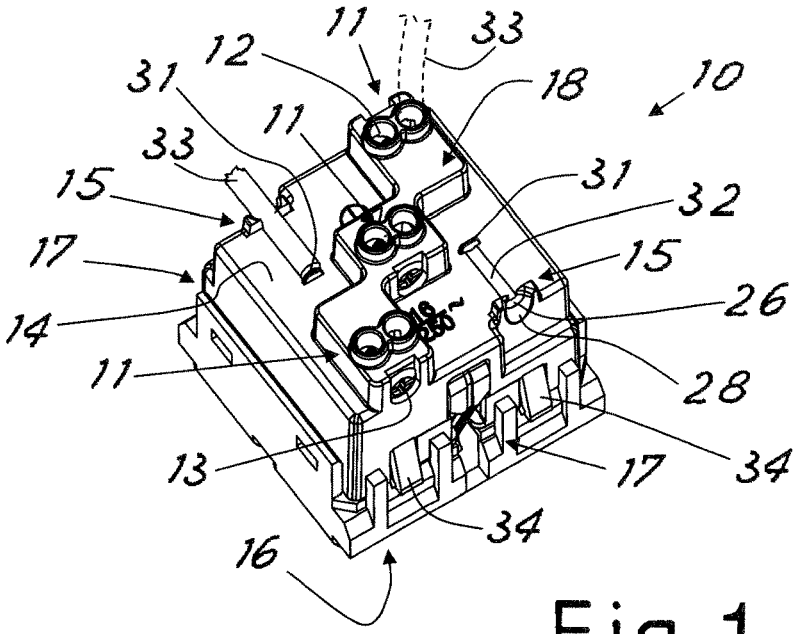
FIG. 1 shows a schematic perspective rear view of a modular electrical device applying the principles of the present invention.

With reference to the figures, FIG. 1 shows an electrical device, denoted generally by 10, applying the principles of the invention.

This device 10 comprises at least one electric terminal 11 (the figures show, by way of example, three terminals) of the type intended to receive and connect a stripped end of an insulated electric wire. The terminal may be, for example, of the screw type, with one seat or several seats 12 for introducing the stripped wire, and a fixing screw 13 arranged preferably at right angles to the insertion seat 12 so as to be visible on one side of the terminal. Other known types of terminal (for example of the push-grip type, snap-engaging type, etc.) may in any case be used, as may be easily imagined by the person skilled in the art.

The device 10 comprises on one of its surfaces 14 also at least one seat 15 for cutting and stripping one end of insulated wire. As will become clear below, this seat 15 allows the insulation of an insulated conductor wire to be cut and then pulled from the end of the wire by means of axial pulling of said wire, so as to expose the conducting end of the wire before insertion inside the corresponding terminal.

In the example of embodiment shown in FIG. 1, the electrical device 10 is a modular component of an electrical installation, moreover of the known type, such as a control module or an electric socket module, and advantageously comprises a front part 16 with an electric socket element or an electric control element (such as a switch, a pushbutton, a diverter, etc.) to which the electrical terminals 11 are connected internally.

The modular component furthermore has opposite side surfaces 17 with known engaging elements (for example snap-engaging teeth or tabs) which are intended to engage the module inside a corresponding support seat or frame.

The rear part 18 of the module comprises finally the at least one terminal and the at least one cutting and stripping seat. In particular, the surface 14 on which the cutting and stripping seat is present may form part of the rear side of the device 10.

Figure 2:
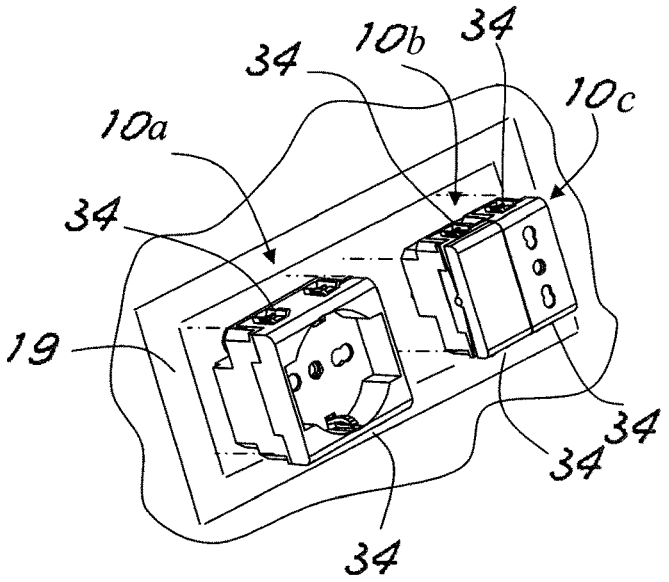
FIGS. 2 and 3 show examples of possible modular devices applying the principles of the invention.
Figure 3:
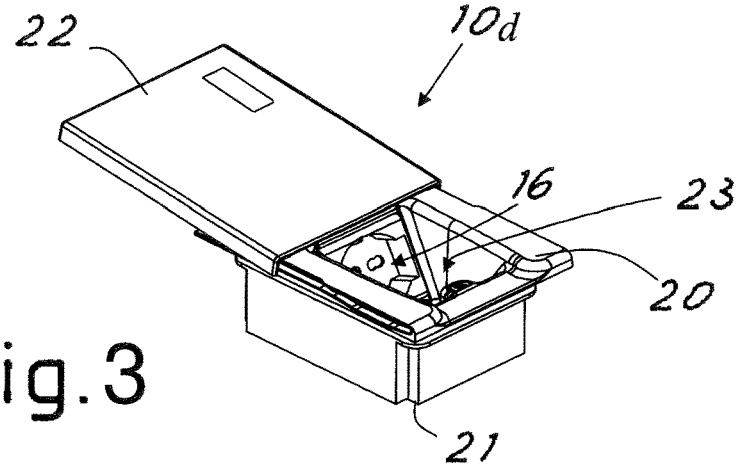

By way of example, FIGS. 2 and 3 show some possible types of modular components 10 (indicated for the sake of convenience by 10*a*, 10*b*, 10*c*). For example the modular component 10*a* is a socket module with a front side provided with a socket of the twin-gauge multistandard type designed to receive both Schuko plugs and in-line plugs with two or three pins and with two different spacings.

The modular component 10*b* is a switch module having a front side provided with a rocker-type control member. The modular component 10*c* is a second type of socket module having a front side provided with a twin-gauge socket for in-line plugs with three pins. The width of the modules 10*b* and 10*c* is half that of the module 10*a*. As is known, the modular components may be arranged alongside each other in the appropriate seats or frames of the installation.

FIG. 2 shows in schematic form a frame 19 in which the modular components may be engaged by means of their lateral engaging elements so as to be mounted with their front sides visible in a wall in which they are flush-mounted (for example using a known flush-mounted box). The frame is not further shown or described in detail since it is known and may be easily imagined by the person skilled in the art.

FIG. 3 shows another possible electrical device 10*d* applying the principles of the present invention and comprising a front part 16 provided with socket (for example of the Schuko or other type) which is mounted in or forms part of a frame 20.

The frame 20 is advantageously intended to be fixed inside a box 21 (for example of the flush-mounted type) and is preferably provided with a lid 22 for slidably closing a compartment 23 inside which the socket 16 emerges. A corresponding known plug (not shown) may thus be internally seated inside the compartment 23 concealed underneath the lid 22 displaced into the closed position.

As can be now easily imagined by the person skilled in the art, the electrical devices or modules 10*a*, 10*b*, 10*c*, 10*d* may be configured at the rear generally in the manner of the device 10 shown in FIG. 1 so that the wires of the electrical installation may be suitably connected to the corresponding terminals. The devices will not be further described in detail since they are per se of the generically known type. According to the invention, they will comprise in a suitable position the electrical connection terminals and one or more cutting and stripping seats 15, as described.

Figure 4:
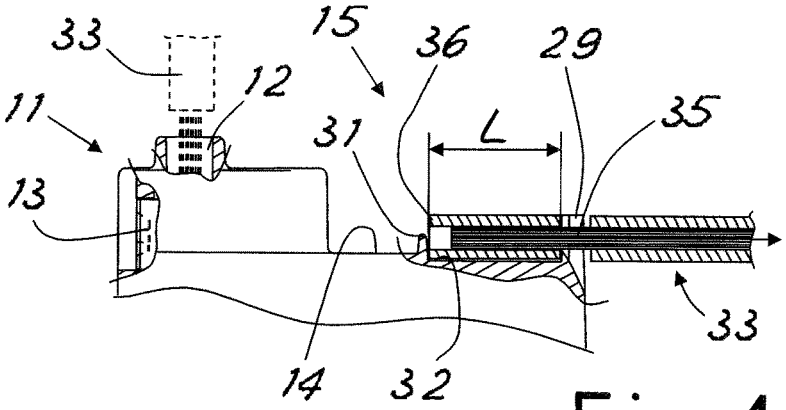
FIG. 4 shows a partially sectioned schematic view of a terminal zone and zone for preparation of a wire in an electrical device applying the principles of the invention.
Figure 5:
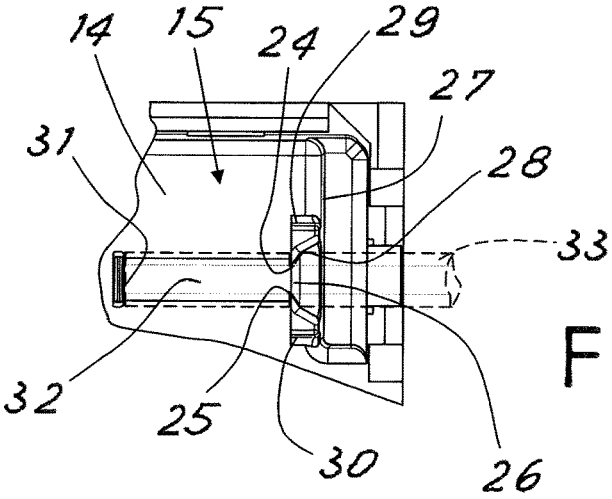
FIG. 5 shows a schematic plan view of a zone for preparation of a wire in an electrical device applying the principles of the invention.

As can be clearly seen in FIGS. 4 and 5, a cutting and stripping seat 15 comprises advantageously two cutting edges 24, 25 which face each other on the sides of the seat 15 in a plane transverse to the surface 14 of the device which contains said seat and the terminal (or terminals) 11 for which the wire stripped by said seat is intended.

As can be seen also in FIG. 1, preferably the cutting edges 24 and 25 form side parts of a cutting flange 26 which also extends from the bottom of the seat which receives the wire between the cutting edges. For example, the flange may be U-shaped with the open part of the U extending above the surface 14. The edges 24 and 25 may be formed both parallel to each other and angled in a V shape so as to facilitate penetration into the insulation.

The distance between the two facing cutting edges 24, 25 is advantageously designed so as to be comprised between the outer diameter of an insulated wire which is to be stripped and the diameter of the internal conducting core of the wire. The two lateral edges therefore form between them a passage between which the insulated wire to be stripped may be pushed so cause cutting of its insulation. In order to ensure a good cutting action preferably the distance between the two cutting edges 24 and 25 is close to the diameter of the conducting core of the wire. In the case where it is envisaged being able to connect wires of varying diameter on the same device, the device may be provided with different cutting and stripping seats, each being dimensionally designed for one of these diameters (or for a small range of these diameters).

The cutting seat is preferably arranged in the vicinity of a side edge 27 of the device so as to extend transversely with respect to this side edge on the surface 14 (thus forming a slightly inset side edge of the surface in which the seat is contained).

Advantageously, the seats may be at least two in number, arranged on opposite side edges of the device, so as to have at least one of them which can be easily reached after the device has been mounted and if necessary partially connected. Again advantageously, in the case of modules which can be arranged alongside each other, the seats may be close to the side edges of the sides which are not occupied and thus remain free and are accessible even after the modules have been arranged alongside each other, as can be easily understood from the figures. Usually these sides not occupied in the side-by-side arrangement are those provided with the engaging elements for engaging the module inside the seat or the receiving frame.

As can be seen from the figures, in any case the cutting edges 24, 25 may be positioned inside a tapered inlet opening 28 which is situated with its widest part on the nearby side edge 27 and on the side wall of the device adjacent to it. As a result, the cutting edges 24, 25 may be advantageously provided with a wedge shape in plan view (as can be clearly seen for example in FIG. 5), this guaranteeing the greater strength of the cutting edge (which may be moulded entirely of plastic) both during penetration into the insulation and during subsequent axial stripping.

The part of the cutting and stripping seat which comprises the cutting edges may also advantageously be designed at least partially in the form of teeth 29, 30 projecting from the surface 14, as schematically shown in the figures.

Again advantageously, the seat 15 may comprise a stop surface 31 (preferably formed as a tooth projecting from the surface 14) arranged at a predefined distance "L" from the cutting edges 24, 25. This allows the length L of the section of wire which is received inside the seat 15 and stripped to be precisely determined. This length L will be chosen so as to be the optimum length for the stripped section of wire which must be inserted inside the corresponding terminal 11. Since the terminal and the stripping seat may be designed together, the optimum stripping action for the particular terminal may thus be easily obtained. So that the wire may be better seated during the stripping operations, the seat 15 may have a channel 32 extending between the stop surface 31 and the cutting edges 24, 25 and intended to accommodate a lateral surface zone of the insulation surrounding the wire section to be stripped. The channel 32 may have advantageously a cross-section which is formed as a circle arc with a diameter equal to the outer diameter of the insulation of the wire to be stripped.

This ensures easy guiding of the end of the wire inside the cutting and stripping seat, between the stop surface 31 and the cutting edges, and the correct execution of the stripping operation.

As can be clearly seen in FIG. 5, during the stripping operation, an insulated conducting wire 33 may be pushed inside the seat 15 with its free end (for example by simply pressing it with a finger between the two cutting edges). The cutting edges thus penetrate into the insulation in the correct position on the two sides of the internal conductor wire. A subsequent axial pulling action on the wire 33 outside of the seat 15 (as shown schematically by way of example in FIG. 4) definitively separates the insulation in the cut zone and allows the section of internal conductor wire 35 with length L to be extracted from the insulating section 36 which has been separated. The wire end 35 thus stripped may then be inserted inside the terminal and stably connected to the device.

The same seat may be obviously used several times in order to strip in succession various wires to be connected to the various terminals.

Figure 6:
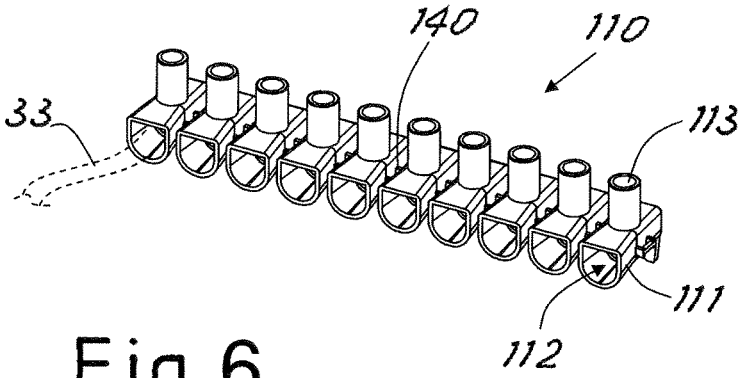
FIGS. 6 and 7 are perspective views, respectively from above and from below, of a further embodiment of a device applying the principles of the invention.
Figure 7:
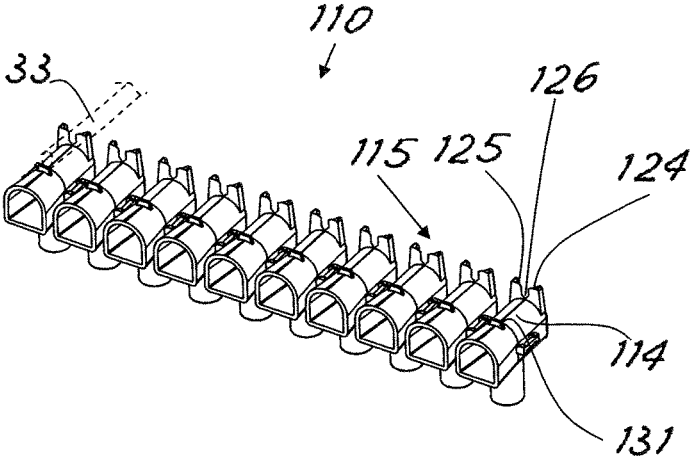

The electrical device according to the invention must not be necessarily be a type of device such as that shown above. It may comprise other known elements in addition to the terminal and the cutting and stripping seat or may also be formed as a single terminal strip, with a plurality of terminals which are varyingly connected together or not so and with one or more cutting and stripping seats. FIGS. 6 and 7 show, for example, a further embodiment of an electrical device applying the principles of the invention and indicated generally by 110 (for the sake of convenience parts which are similar to those of the previous embodiments will be indicated below by the same numbering increased by 100).

The electrical device 110 is formed as an electrical terminal strip and comprises a row of aligned terminals 111. This row may be for example formed by means of the connection of single terminals or may be formed by means of the single-piece moulding of the external insulation casing of the entire row of terminals. In this second case, the terminals may be formed so as to be separable from each other by means of cutting or breakage of a mutual interconnection zone of reduced thickness (indicated generally by 140).

Each terminal 11 may be of the known screw type and comprises a seat 112 for introduction of the stripped wire and a fixing screw 113. As may be easily imagined by the person skilled in the art, the insulation casing contains a metal insert (not shown) which receives the stripped wire and into which the fixing screw 113 is screwed. The fixing screw is preferably arranged at right angles with respect to the insertion seat 112. The terminals may also be of the known type with inlets for the wire at both ends and with a fixing screw close to each end.

In this example too, other known types of terminal (for example of the push-grip type, snap-engaging type, etc.) may in any case be used, as may be easily imagined by the person skilled in the art.

The device 110 comprises on a surface 114 thereof also at least one seat 115 for cutting and stripping one end of an insulated wire. Advantageously, in the type of terminal shown in the drawings, the surface 114 is situated opposite to the side of the terminal from which the screw 113 projects.

The seat 115 may be substantially similar to that described above, in particular with reference to FIGS. 4 and 5. In particular it may comprise advantageously two cutting edges 124, 125 which face each other on the sides of the seat 115 in a plane transverse to the surface 114. As can be clearly seen in FIG. 7, preferably the cutting edges 124 and 125 form lateral parts of a cutting flange 126 which also extends from the bottom of the seat which receives the wire between the cutting edges. Preferably, the cutting edges 124 and 125 are at one end of the terminal 111 opposite to the end 112 for entry of the wire inside the terminal. The surface 114 may also advantageously comprise a stop surface 131 (preferably in the form of a tooth) for determining the length of the section which is stripped by the seat 115, as already described above.

Stripping may be performed by simply pushing one end of an insulated wire 33 into the seat 115, as shown in broken lines in FIG. 7, pulling it axially so as to strip its end, and then inserting it into the terminal, as shown in broken lines in FIG. 6.

At this point it is clear how the predefined objects have been achieved. Based on the principles of the invention, stripping of the wires to be connected is easy, quick and does not require special tools. Moreover, it is possible to achieve always optimum stripping since the stripping seat may be dimensionally designed so as to strip exactly the length of wire most suited for the specific terminal or terminals with which the seat is associated in the electrical device.

Moreover, the seat according to the invention may be easily made using moulded plastic and, preferably, also as one piece with a shell part of the device, as is clear from the figures. In this way the cutting and stripping seat does not result in any additional cost for manufacture of the device.

The seat is also perfectly safe and there is no risk of accidental injury when handling the device.

Obviously the description above of an embodiment applying the innovative principles of the present invention is provided by way of example of these innovative principles and must therefore not be regarded as limiting the scope of the rights claimed herein.

For example the number and position of the seats, as well as the number and position of the terminals and the form and type of electrical device may be different from those shown here by way of example. For example, the devices may be per se also complex components, such as domotics devices or modules, with integrated electrical and electronic components and terminal strips for connection to an installation.

Obviously, the exact direction of pulling of a wire for the stripping operation must not be necessarily along the axis of extension of the cutting and stripping seat or perfectly perpendicular to the plane which contains the cutting edges. For example it may be advantageous to pull the wire diagonally (slightly downwards in FIG. 4) in order to facilitate stripping separation of the insulation without the end to be stripped coming out of the cutting zone between the edges before separation. The pulling action on the wire will in any case be axial relative to the extension of said wire, even though if necessary along two different directions before and after the cutting edges.

The invention claimed is:

1. Electrical device (10) comprising at least one electric terminal (11) of the type intended to receive and connect to the device a stripped end of an insulated electric wire, characterized in that a surface (14) of the device is provided with at least one cutting and stripping seat (15) for one end of an insulated wire, intended to cut the insulation of the insulated wire and strip it from the end of the wire by means of insertion of the end of the wire into the seat (15) followed by axial pulling of the wire before inserting the wire inside the terminal (11), the cutting and stripping seat (15) being made of moulded plastic and formed as one piece with a shell part of the device.

2. Device according to claim 1, characterized in that the cutting and stripping seat (15) comprises two cutting edges (24, 25) which face each other on the sides of the seat in a plane transverse to the said surface (14).

3. Device according to claim 1, characterized in that the cutting and stripping seat (15) is arranged close to a side edge (27) of the device and extends transversely relative to said side edge (27) of the device.

4. Device according to claim 2, characterized in that the cutting and stripping seat (15) comprises a stop surface (31) which is situated at a predefined distance from the cutting edges (24, 25) so as to define the length of the wire section which is received inside the cutting and stripping seat (15) and stripped.

5. Device according to claim 4, characterized in that the cutting and stripping seat (15) comprises between the stop surface (31) and the cutting edges (24, 25) a channel (32) intended to accommodate a lateral surface zone of the insulation surrounding a wire section to be stripped.

6. Device according to claim 2, characterized in that the cutting edges (24, 25) form lateral parts of a cutting flange (26).

7. Device according to claim 1, characterized in that it is a modular component of an electrical installation, such as a control module or an electric socket module (10*a*, 10*b*, 10*c*, 10*d*).

8. Device according to claim 7, characterized in that it has a front side (16) comprising an electric socket or an electric control element, side surfaces (17) comprising engaging elements (34) intended to engage inside a corresponding support frame (19) and rear part (16) which comprises the at least one terminal (11) and the at least one cutting and stripping seat (15).

9. Device according to claim 1, characterized in that it is in the form of a terminal strip (110) with a plurality of aligned terminals (111).

* * * * *